US008418766B2

(12) United States Patent
Luppi

(10) Patent No.: US 8,418,766 B2
(45) Date of Patent: Apr. 16, 2013

(54) UNDERWATER CONNECTION INSTALLATION

(75) Inventor: Ange Luppi, Nîmes (FR)

(73) Assignee: Technip France (FR)

( * ) Notice: Subject to any disclaimer, the term of this patent is extended or adjusted under 35 U.S.C. 154(b) by 267 days.

(21) Appl. No.: 12/863,228

(22) PCT Filed: Jan. 23, 2009

(86) PCT No.: PCT/FR2009/000075

§ 371 (c)(1),
(2), (4) Date: Aug. 17, 2010

(87) PCT Pub. No.: WO2009/112687

PCT Pub. Date: Sep. 17, 2009

(65) Prior Publication Data

US 2010/0314123 A1 Dec. 16, 2010

(30) Foreign Application Priority Data

Jan. 25, 2008 (FR) ..... 08 00411
Mar. 21, 2008 (FR) ..... 08 01560

(51) Int. Cl.
*E21B 19/16* (2006.01)

(52) U.S. Cl.
USPC ..... 166/345; 166/338; 166/341; 166/343; 166/367; 166/380; 405/169; 285/24

(58) Field of Classification Search ..... 166/345, 166/338, 341, 343, 344, 351, 352, 360, 367, 166/378–380; 405/158, 169, 184.4, 224.2–224.4
See application file for complete search history.

(56) References Cited

U.S. PATENT DOCUMENTS 3,724,061 A * 4/1973 Schipper ..... 29/464
4,102,146 A * 7/1978 Dietrich ..... 405/169
4,191,256 A * 3/1980 Croy et al. ..... 166/343
4,367,055 A * 1/1983 Gentry et al. ..... 405/169
4,388,022 A * 6/1983 Gentry et al. ..... 405/224.3
4,400,109 A * 8/1983 Gentry et al. ..... 405/224.3
(Continued)

FOREIGN PATENT DOCUMENTS

FR 2 473 673 A 7/1981
FR 2 497 264 A 7/1982
(Continued)

OTHER PUBLICATIONS

International Search Report dated Aug. 20, 2009, issued in corresponding international application No. PCT/FR2009/000075.

*Primary Examiner* — Matthew Buck
(74) *Attorney, Agent, or Firm* — Ostrolenk Faber LLP

(57) ABSTRACT

An underwater connection installation (26) and a laying method for connecting a riser and a flexible pipe (22) that are intended for carrying hydrocarbons. A post (28) is attached to a float (20) to suspend the riser (12) below the surface. The post (28) supports a gooseneck shape pipe (54) that has a bent-over outlet free end (58) ending in a first coupling (60). A coupling end piece (32) mounted on the flexible pipe (22) includes a second coupling (86). The coupling end piece (32) and the post (28) define mechanical guides including complementary frustoconical rings (64, 84). The driving of the coupling end piece (32) and of the bent-over free end (58) toward each other causes the frustoconical rings (64, 84) to engage one another to bring about coaxial alignment of the couplings (60, 86).

19 Claims, 3 Drawing Sheets

U.S. PATENT DOCUMENTS

| | | | | | |
|---|---|---|---|---|---|
| 4,423,984 | A | * | 1/1984 | Panicker et al. | 405/224.3 |
| 4,490,073 | A | * | 12/1984 | Lawson | 405/169 |
| 4,632,432 | A | * | 12/1986 | Reneau | 285/24 |
| 4,643,614 | A | * | 2/1987 | Laursen | 405/169 |
| 4,823,879 | A | * | 4/1989 | Brammer et al. | 166/341 |
| 4,848,949 | A | * | 7/1989 | Castel | 403/12 |
| 4,878,694 | A | * | 11/1989 | Castel | 285/24 |
| 4,906,136 | A | * | 3/1990 | Norbom et al. | 405/169 |
| 5,046,896 | A | * | 9/1991 | Cole | 405/195.1 |
| 5,067,429 | A | * | 11/1991 | Castel | 114/230.26 |
| 6,558,084 | B2 | * | 5/2003 | Moog et al. | 405/224 |
| 6,805,382 | B2 | * | 10/2004 | Jennings | 285/18 |
| 7,086,807 | B2 | * | 8/2006 | Mackinnon | 405/170 |
| 7,112,009 | B2 | * | 9/2006 | Mackinnon | 405/173 |
| 7,434,624 | B2 | * | 10/2008 | Wilson | 166/368 |
| 7,572,085 | B2 | * | 8/2009 | Luppi | 405/158 |
| 8,057,126 | B2 | * | 11/2011 | Mogedal et al. | 405/170 |

FOREIGN PATENT DOCUMENTS

| | | | |
|---|---|---|---|
| FR | 2 588 926 | A | 4/1987 |
| GB | 2 090 221 | A | 7/1982 |
| GB | 2 146 685 | A | 4/1985 |

* cited by examiner

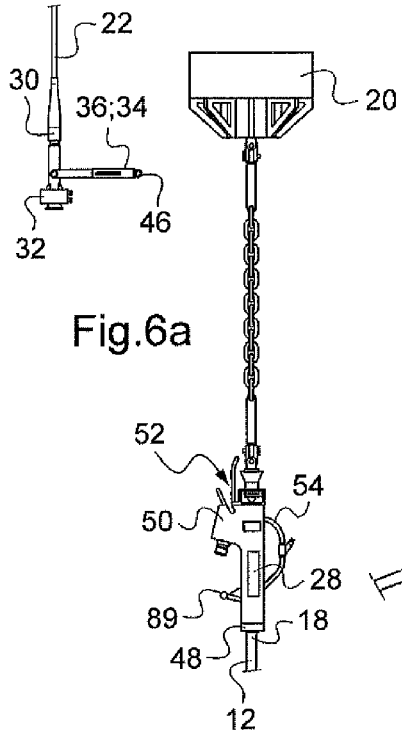
Fig.6a
Fig.6c
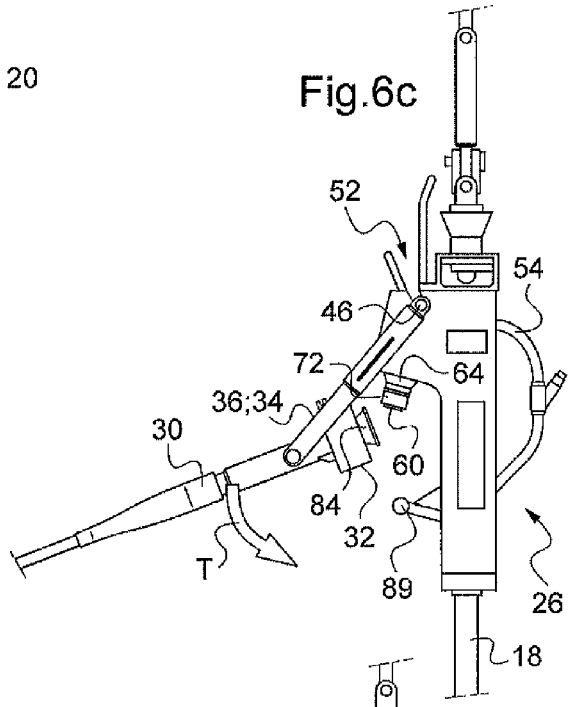
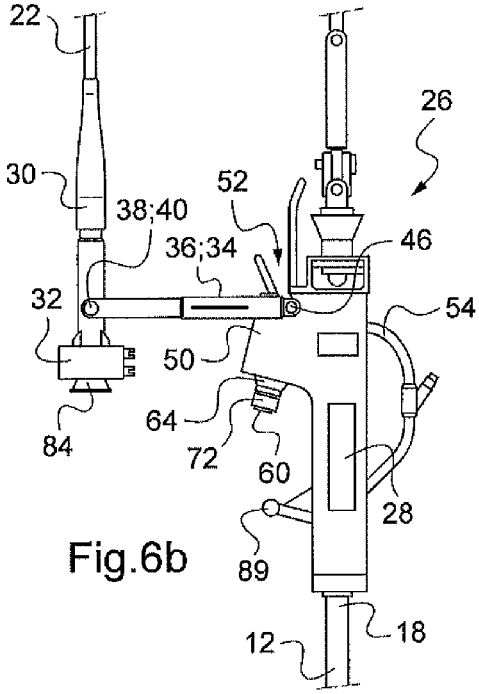
Fig.6b
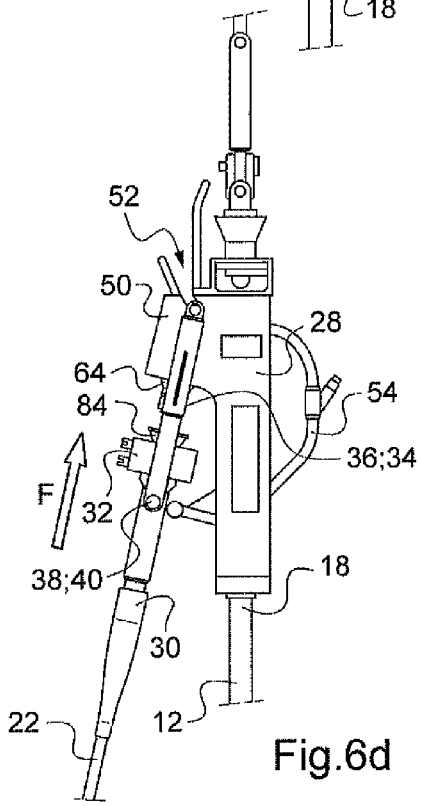
Fig.6d

UNDERWATER CONNECTION INSTALLATION

CROSS REFERENCE TO RELATED APPLICATION

The present application is a 35 U.S.C. §§371 national phase conversion of PCT/FR2009/000075 filed Jan. 23, 2009, which claims priority of French application Ser. No. 08/00411, filed Jan. 25, 2008, and French application Ser. No. 08/01560, filed Mar. 21, 2008, the disclosures of both of which are incorporated by reference herein. The International Application was published in the French Language

BACKGROUND OF THE INVENTION

The invention relates to the field of seabed-to-surface installations of the hybrid tower type making it possible to carry fluids and in particular hydrocarbons from a seabed installation connected to wellheads to a surface installation.

Normally, hybrid towers comprise at least one riser, usually rigid, suspended below the surface from a float and anchored in the seabed, and at least one flexible pipe which extends in catenary suspension between the riser, at the float, and a surface installation. The riser and the flexible pipe are then connected by means of an underwater connection installation.

The underwater connection installation comprises a frame forming a post which is kept below the surface by the float formed of usually cylindrical air tanks. Said post extends along these cylindrical air tanks and it has a base at the bottom end of the tanks in order to suspend said riser, and a portion overhanging said base at the top end of the tanks. It also comprises at least one gooseneck pipe, which has an inlet end secured to the base of the post and a curved free outlet end which extends into the top post portion and which is curved toward the bottom end of the tanks. The curved free ends of the gooseneck pipes are engaged in a first inclined plane and are terminated by a first coupling which has a first centering lip. Moreover, said installation comprises at least one coupling endpiece suitable for being mounted at one end of a flexible pipe. The coupling endpiece comprises a second coupling having a second centering lip. Moreover, the coupling endpiece is installed on a second inclined plane, which is capable of being installed on the post by means of a diver and then of being guided in translation toward the first inclined plane in order to coaxially guide said couplings toward one another and in order to bring the first and second lips into contact with one another. Then, by installing locking means on the couplings, the seal is provided between the riser and the flexible pipe. Reference can be made notably to document FR 2 497 264 which describes a connection installation of this type.

A major drawback of the aforementioned connection installations is that they require human intervention below the surface to make the connection.

Therefore, a problem that arises and that the present invention aims to solve is to provide a connection installation which makes it possible to make a sealed connection below the surface between a riser and a flexible pipe while avoiding a human intervention below the surface.

BRIEF DESCRIPTION OF THE INVENTION

For the purpose of solving this problem, and according to a first aspect, the invention proposes an underwater connection installation, or connector for connecting a riser and a flexible pipe intended for carrying hydrocarbons by means of a connection assembly. The installation comprises a post suitable for being held below the surface by a float. The post has a base for suspending said riser and a top portion above and overhanging said base. The post preferably comprises a gooseneck pipe having an inlet end secured to said base and a curved free outlet end which extends into said top post portion. The curved free end is terminated by a first coupling having a first centering lip and forming a tubular joint. The installation also comprises a coupling endpiece suitable for being mounted at one end of said flexible pipe. The coupling endpiece comprises a second coupling having a second centering lip, said coupling endpiece and said post comprising mechanical guidance means for coaxially guiding said couplings and supporting said first and second lips in contact with one another when said coupling endpiece and said curved free end are driven toward one another. According to the invention, said mechanical guidance means comprise matching frustoconical rings, one of said rings being mounted on said top post portion, around said curved free end, so that the axes of said one of said rings and of said first coupling are substantially parallel, while the other of said rings is installed on said coupling endpiece coaxially with said second coupling. The driving of said coupling endpiece and of said curved free end causes the engagement of said frustoconical rings in one another and the coaxial alignment of said couplings, while the contact of said first and second lips causes the self-centering of the couplings.

Therefore, one feature of the invention lies in the use of matching frustoconical rings, one installed around the curved free end of the pipe and the other on the coupling endpiece so that bringing the coupling endpiece and the curved free end toward one another causes the engagement of the frustoconical rings with one another and in consequence a first guidance of the couplings relative to one another. In this way, despite the difficulties of guidance of the couplings below the surface, due to the sea currents, but also to the movements of the surface installations from which the closing operations are controlled, the couplings can nevertheless be guided toward one another with sufficient accuracy for their lips to come into contact with one another. Moreover, the lips have matching shapes, as will be explained below, which allow a precise self-centering of the couplings with one another and which therefore ensure a perfect seal.

Advantageously, the connection installation comprises a first locking device, consisting of a mechanical locking system, for locking said rings when they are engaged in one another and kept immobile and in a fixed position relative to one another. In this position, the couplings are held to one another, lip against lip, and they are then self-centered. Therefore, preferably, the connection installation comprises a second locking device, consisting of a hydraulic locking system, for locking said couplings when said couplings are self-centered. In this way, by virtue of the second locking device, the couplings are locked relative to one another in order to provide a perfect seal between them.

According to a particularly advantageous embodiment of the invention, said first coupling has a first collar behind the first lip, while said second coupling has a second collar also behind the second lip. The coupling endpiece comprises at least two hoop segments with two inner shoulders designed to be driven radially toward one another in order to keep the collars engaged so as to form said second locking means. Therefore, before the lips of the couplings are brought into contact with one another, the two hoop segments, for example semicircular hoop segments, are separated from one another in order to allow the couplings and also the collars to close together. Then, when the couplings are in their closest position, the collars are also and then the two hoop segments are driven radially toward one another around the couplings, so that the inner shoulders come respectively to bear behind the collars. In this way, the couplings are then totally trapped together.

Preferably, said one of said frustoconical rings has a base secured to said top post portion and at the other end a top extended by a free cylindrical sleeve, said first lip protruding from said free cylindrical sleeve. Therefore, the base of the frustoconical ring which has a larger diameter than the top is secured to the top post portion, so that the top of the frustoconical ring protrudes from the post. Moreover, the frustoconical ring, at its top, is extended by a free cylindrical sleeve from which the first lip forming the tubular joint of the first coupling protrudes.

Moreover, said one of said frustoconical rings secured to the post has a groove situated toward said cylindrical sleeve at the top of the frustoconical ring, while said coupling endpiece comprises a radial stopping device, or a mechanical locking device, suitable for being engaged in said groove, or recess, as will be explained in greater detail in the rest of the description, so as to form said first locking device.

Advantageously, said first coupling is mounted so as to have a range of movement inside said cylindrical sleeve so as to allow the self-centering of the couplings with one another, when the coupling endpiece is driven toward the top post portion and the frustoconical rings are driven into one another. Specifically, the other of said frustoconical rings is held in a fixed position relative to the second coupling, when the frustoconical rings are engaged coaxially in one another, the centering of the couplings relative to one another when their lips come into contact requires the first coupling to be allowed lateral movement relative to the second.

According to a particularly advantageous embodiment, said other of said frustoconical rings has a top secured to said coupling endpiece and at the other end a free base protruding from said coupling endpiece and inside which the cylindrical sleeve of said one of said frustoconical rings will come to engage when the coupling endpiece is brought closer to said curved free end.

Moreover, and in a particularly advantageous manner, said first centering lip has a first female frustoconical bearing surface, while said second centering lip has a second male frustoconical bearing surface. In this way, when the lips come into contact, and the second male frustoconical bearing surface is engaged inside the first female frustoconical bearing surface, with a maximum lateral clearance, the couplings are self-centered gradually as they close with one another, the bearing surfaces being driven slidingly one against the other for a precise and final centering.

Moreover, said inlet end of said gooseneck pipe is advantageously secured to said base, while said gooseneck pipe extends freely in said post, so that said free end is able to move elastically relative to said top post portion. Specifically, since the gooseneck pipe is made of metal, and the distance separating its inlet end from its free outlet end is great enough, for example five meters, so that the pipe can bend substantially. This feature thus makes it possible to apply the second lip of the second coupling against the first lip of the first coupling, which, for its part, is secured to the pipe, and to further drive the coupling endpiece toward the free end of the pipe, while allowing a slight bending of the latter. In this way, the return force of the pipe allows the precise self-centering of the couplings, as will be explained in greater detail in the rest of the description.

According to another particularly advantageous embodiment, said coupling endpiece is fitted with a retractable flange forming guidance means suitable for coming to face said second coupling, while said post has a recess, forming a receptacle, in its top portion opposite to said first coupling of said curved free end, and said flange being suitable for being brought into engagement inside said recess, while said coupling endpiece is capable of coming to face said curved free end, said retractable flange being suitable for being retracted in order to drive said coupling endpiece and said curved free end toward one another. The recess provides a pivot connection for the flange.

Therefore, the coupling endpiece and the flexible pipe on which it is mounted are capable of being guided vertically in the water from the surface to a position beneath the surface without the intervention of divers, in order to bring the flange into engagement in the recess. Then, by paying out more of the flexible pipe toward the seabed, the coupling endpiece pivots around the recess by virtue of the flange which holds it and is adjusted facing the curved free end. Then, with the flange being retracted, the coupling endpiece is driven toward said curved free end in order first to engage the frustoconical rings in one another and then to self-center the couplings.

Preferably, said retractable flange comprises two telescopic arms having, on the one hand, two first ends mounted coaxially and in a diametrically opposite position on said coupling endpiece and, on the other hand, two second opposite ends joined together by a crosspiece. Advantageously, said retractable flange is mounted pivotingly on said coupling endpiece so as to be able to extend it first substantially perpendicularly to the axis of the second coupling of the flexible pipe when the latter descends in order to be able to engage it in the recess. Then, the coupling endpiece is rotated relative to the flange so that it extends in line with the coupling endpiece opposite the flexible pipe. In this position, it can be retracted in order to make the connection. Advantageously, said coupling endpiece comprises a device for stopping the pivoting of said flange in order to be able to precisely immobilize it in the position that is substantially perpendicular to the axis of said second coupling and in said position facing said second coupling during tension.

Moreover, said post has receiving means forming an abutment between said top portion and said base in order to receive as a support said coupling endpiece when the latter pivots about the recess.

The present invention, according to a second aspect, also relates to a method for placing a hybrid tower, which is intended for carrying hydrocarbons. The hybrid tower comprises a riser, for example a rigid pipe, a system for anchoring the riser to the seabed and a flotation element for suspending said riser substantially vertically in line with said anchoring system. Moreover, said hybrid tower comprises a connection assembly, and more precisely an underwater connection installation for connecting together said riser and a flexible pipe which extends in catenary suspension from a surface installation to the underwater connection installation. Said installation comprises a post suitable for being held beneath the surface by said flotation element or float. This post has a base for suspending the riser and a top portion overhanging said base. It also comprises a gooseneck pipe having an inlet end secured to said base and a curved free outlet end which extends into said top post portion. The curved free end is terminated by a first coupling having a first centering lip. Moreover, the post has a recess, or receptacle of the connection assembly, in its top portion opposite to said first coupling of the curved free end and its function will be explained below. The installation also comprises a coupling endpiece suitable for being mounted at one end of the flexible pipe, and itself comprises a second coupling having a second centering lip. The coupling endpiece and the post comprise mechanical guidance means for coaxially guiding the couplings and supporting the first and second lips in contact with one another when the coupling endpiece and the post are driven toward one another; said mechanical guidance means comprise matching frustoconical rings, one of said rings being mounted on said top post portion around said curved free end so that the axes of said one of said rings and of said first coupling are substantially parallel, while the other of said rings is installed on said coupling endpiece coaxially with said second coupling. The coupling endpiece is fitted with a retractable flange, or guidance means, suitable for coming to face said second coupling, and also first and second locking means, or locking means. The first locking means are designed to lock said rings when they are engaged in one another, while the second locking means are designed to lock together said couplings when they are self-centered. Therefore, said method being of the type in which, in an installation step, the rigid riser is installed with its anchoring means and its flotation elements. Moreover, said placing method comprises a deployment step in which the flexible pipe is deployed vertically having its coupling endpiece which is fitted with its retractable flange and its first and second locking means or locking means. The method comprises an engagement step in which said flange is brought into engagement inside said recess or the guidance means with the receptacle of the connection assembly. Then, in a swiveling step, the flexible pipe is swiveled in a predetermined curve until it aligns with the attachment elements, and more precisely said coupling endpiece comes to face said curved free end. Then finally, in a tension step, said retractable flange is retracted in order to drive said coupling endpiece and said curved free end toward one another. The coupling endpiece of the flexible pipe is driven until the means for attaching the flexible pipe engage with the connection assembly. In other words, the driving of the coupling endpiece toward the curved free end and consequently of said couplings toward one another, causes said frustoconical rings to engage in one another and causes the coaxial alignment of said couplings, while the contact of said first and second lips causes the self-centering of the couplings.

BRIEF DESCRIPTION OF THE DRAWINGS

Other particular features and advantages of the invention will emerge on reading the description given below of a particular embodiment of the invention, given as an indication but not being limiting, with reference to the appended drawings in which.

DESCRIPTION OF A PREFERRED EMBODIMENT

Figure 2:
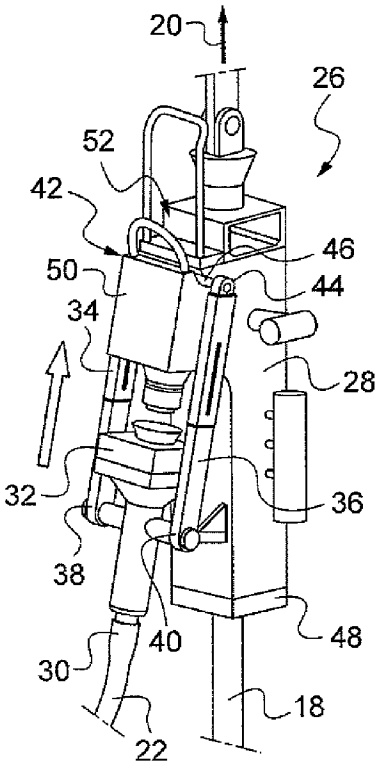
FIG. 2 is a schematic view in perspective of the connection installation in the situation as shown in FIG. 1.
Figure 1:
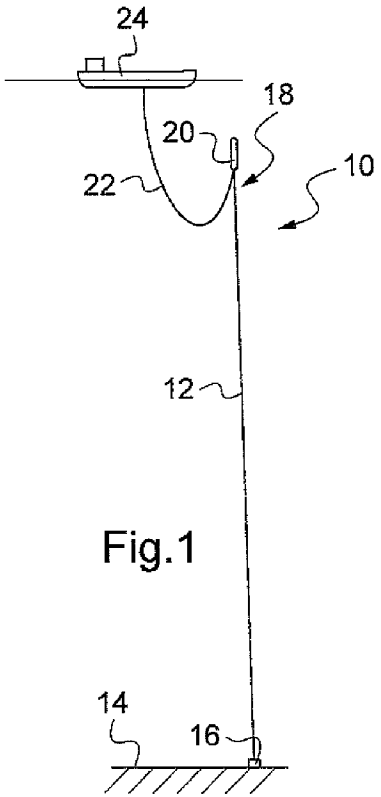
FIG. 1 is a schematic view of a connection installation according to the invention in an installed situation.

FIG. 1 shows schematically a hybrid tower 10 comprising a rigid riser 12 attached to a seabed 14 by means of an anchoring system 16. Moreover, the rigid riser 12 has a top portion 18, or top end, suspended from a float 20, or a buoy, in which a sufficient quantity of air is trapped to keep the rigid riser in its vertical position. Moreover, the hybrid tower 10 comprises a flexible pipe 22 which extends in catenary suspension between a surface ship 24 and the top end 18 of the rigid riser 12. Therefore, an underwater connection installation 26 according to the invention shown in detail in FIG. 2 and forming a connector, makes it possible to connect together the riser 12 and the flexible pipe 22 in catenary suspension. Reference will be made to FIG. 2 to describe first detail elements of the connection installation 26.

The connection installation 26 therefore comprises a post 28 which forms a connection assembly and which is placed between the float 20 and the rigid riser 12 so as to be able to connect the rigid riser to the flexible pipe 22 which is extended in catenary suspension between the surface installation 24 and the post 28.

The flexible pipe 22 has an end 30 into which a coupling endpiece 32 is fitted. Moreover, the coupling endpiece 32 is fitted with two telescopic arms 34, 36 having two first ends 38, 40 mounted coaxially so as to pivot about an axis perpendicular to the axis of the flexible pipe 22 and in diametrically opposite positions on the coupling endpiece 32. The two telescopic arms 34, 36 are in this instance extended in line with the coupling endpiece 32 away from the end 30 of the flexible pipe 22, and they have two second ends 42, 44 joined together by a crosspiece 46 that will be described in greater detail in the rest of the description and which, in this instance, is masked by the post 28. The two telescopic arms 34, 36 connected by the crosspiece 46 then form a pivoting flange.

The post 28 has a base 48 from which the rigid riser 18 is suspended and a top portion 50 overhanging the base 48. This top portion 50 has a recess 52 forming a hook or a receptacle, inside which the crosspiece 46 connecting the two telescopic arms 34, 36 is precisely engaged.

Figure 3:
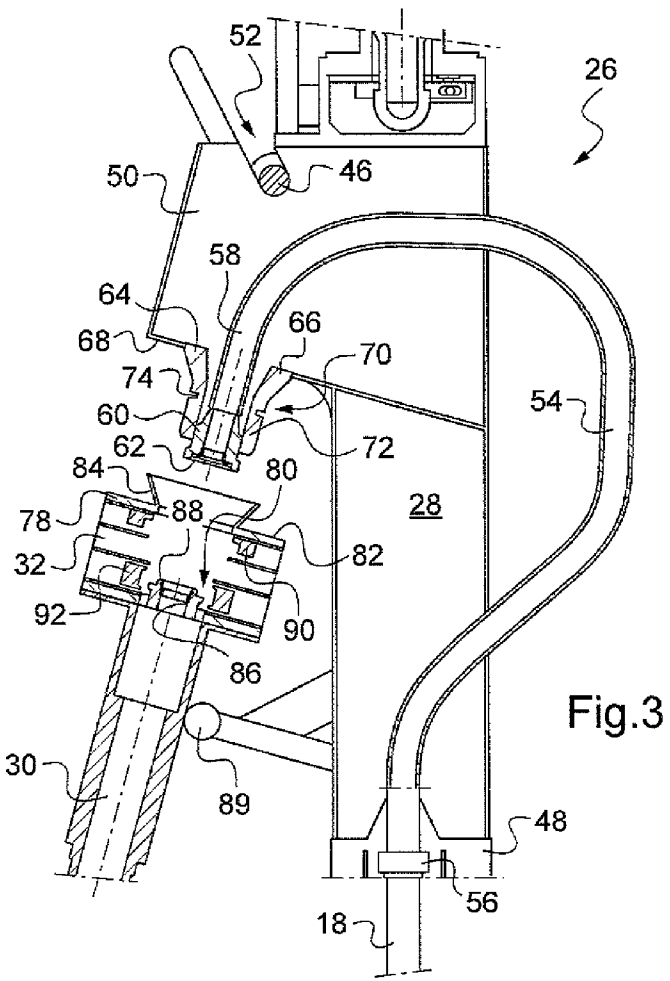
FIG. 3 is a schematic view in axial section of the connection installation according to the invention.

Reference is now made to FIG. 3 illustrating in greater detail the underwater connection installation 26 according to the invention.

This shows the top portion 18 of the rigid riser and the end 30 of the flexible pipe 22 furnished with its coupling endpiece 32 and the post 28. It also shows its base 48 and, at the other end, its top portion 50 which overhangs the base 48 and in which the recess 52 is arranged.

FIG. 3 also illustrates a gooseneck pipe 54 which extends through the post 28 and which has an inlet end secured to the base 48 and, at the other end, a curved free end 58 which, for its part, extends into the top portion 50. The post 28 consists of a metal frame of a height ranging between seven and twelve meters, for example eight meters. The inlet end 56 of the gooseneck pipe 54 is mounted rigidly onto the base 48 of the post 28 while the pipe itself extends freely through the post 28 passing through its walls through recesses of dimensions much greater than the diameter of the pipe 54. In this way, the gooseneck pipe 54 is capable of bending substantially when forces are exerted on the curved free end 58 as will be explained below, without the walls of the post 28 preventing it. Moreover, the gooseneck pipe 54 has, between the base 48 of the post 28 and the top portion 50, in a portion separate from the post 28, a T-shaped sleeve that can be closed off, forming an inspection hatch so that abrasive elements can be inserted into the pipe 54 or so that it is possible to inject treatment liquids, for example anticorrosion liquids into the riser 12.

The curved free end 58 has a first coupling 60, which first coupling has a first centering lip 62. Moreover, and this is one of the essential features of the invention, the top portion 52 of the post 28 is fitted with a first frustoconical ring 64 in which the curved free end 58 and the first coupling 60 in line with it extend coaxially. The first frustoconical ring 64 forms a conical mouth. This first frustoconical ring 64 has a base 66 secured to a wall 68 of the top portion 50 and a top 70 extended by a free cylindrical sleeve 72. In addition, the top 70 of the first frustoconical ring 64 has a groove 74 behind the free cylindrical sleeve 72. Therefore, the curved free end 58 extends freely inside the first frustoconical ring 64 so that the first lip of the first coupling 60 protrudes substantially from the free cylindrical sleeve 72 and with a range of movement inside this free cylindrical sleeve 72. Details will be given below with reference to FIG. 4 of the modalities of operation of these elements adjusted in this way.

Moreover, the coupling endpiece 32 held facing the curved free end 58 has a casing 78 in the bottom of which emerges the end 30 of the flexible pipe 22 and which, on the front face 82, has a second frustoconical ring 84 forming a flared conical end. In addition, the coupling endpiece 32 of the flexible pipe 22 has a metal tubular member behind said casing 78 in order to protect it. Moreover, the telescopic arms are installed on said tubular member which makes it possible to obtain a relatively rigid connection. Additionally, the end 30 of the pipe has an outer protective sleeve which extends behind said metal tubular member. This sleeve is optionally made of relatively rigid polyurethane, both to protect the end 30 but also to locally stiffen it so that it does not interfere with the elements of the post 28 during placement. The end 30 of the flexible pipe 22 terminates in a second coupling 86 which is mounted coaxially relative to the second frustoconical ring 84 and which has a second centering lip 88. It will be noted that the second frustoconical ring 84 is installed on the front face 82 of the casing 78, the reverse of the first frustoconical ring 64, the top secured to the front face 82 and the free base. In addition, the coupling endpiece 32 comprises first concentric locking means 90 installed inside the casing and behind the second frustoconical ring 84, and also second locking means 92 situated inside the casing 78 close to the bottom 80, in line with the second centering lip 88 of the second coupling 86. The first concentric locking means 90 consist of two half-hoops having two inner half-ribs 91, 93 and they form radial stopping means designed to engage in the groove 74, as will be explained below, while the second locking means 92 comprise two hoop segments having respectively two identical facing inner shoulders.

Therefore, in the position as shown in FIG. 3, in which the coupling endpiece 32, resting on an abutment 89, is situated facing the curved free end 58 and the second frustoconical ring 84 facing the first frustoconical ring 64, the coupling endpiece 32 will be precisely driven in translation substantially on the axis of the curved free end 58 by virtue of the telescopic arms 34, 36 described with reference to FIG. 2, which are then retracted while bearing in the recess 52 by means of the crosspiece 46. In this way, despite the clearances inherent in the mounting method and in the marine environment, the outer diameter of the free cylindrical sleeve 72 is sufficiently small compared with the inner diameter of the base of the second frustoconical ring 84 for an axial offset, precisely of the second frustoconical ring 84 relative to the free cylindrical sleeve 72, to nevertheless allow the engagement of the sleeve 72 inside the second frustoconical ring 84 and the subsequent guidance of the coupling endpiece 32 when it is driven even further toward the curved free end 58.

Figure 4:
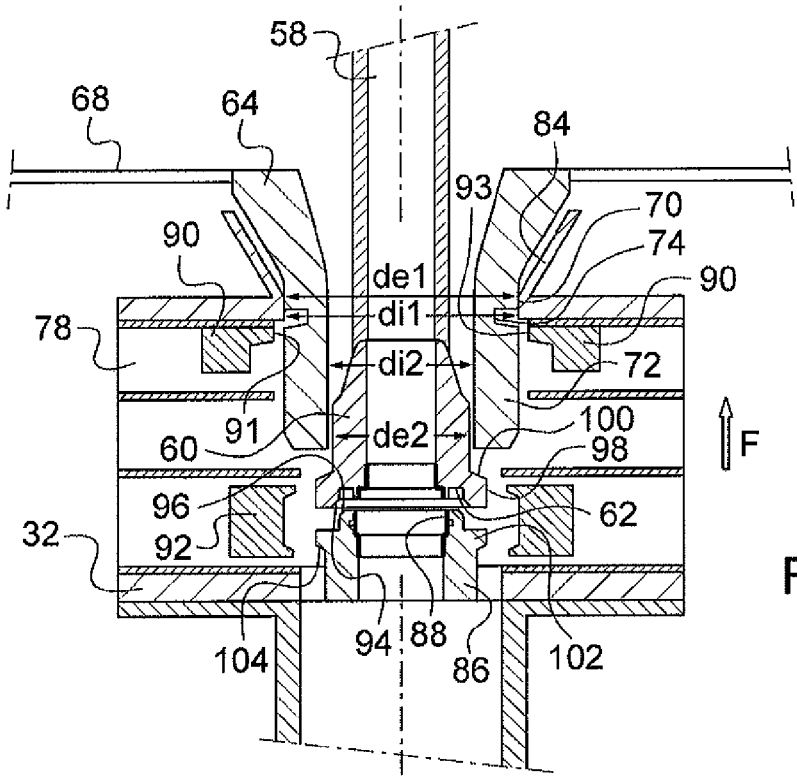
FIG. 4 is a schematic view in detail of the connection installation shown in FIG. 3 in a first position.

Now, with reference to FIGS. 4 and 5, an explanation in greater detail will be given of the method of interaction of the frustoconical rings notably when the coupling endpiece 32 is driven toward the curved free end 58. First of all, FIG. 4 shows the first frustoconical ring 64 secured to the wall 68, and the second frustoconical ring 84 inside which the first frustoconical ring 64 is partially engaged. Therefore, the top 70 of the first frustoconical ring 64, the outer diameter of which de1 is equal to that of the outer diameter of the free cylindrical sleeve 72 that is in line with it, is engaged inside the first frustoconical ring 84 and notably inside its top the inner diameter di1 of which, give or take the functional clearance, is equal to the outer diameter de1 of the top 70. In this way, when the coupling endpiece 32 is driven axially in translation toward the curved free end 58 in the direction of the arrow F, the free cylindrical sleeve 72 is thereby guided axially in translation inside the casing 78 and consequently the second coupling 86 is driven coaxially toward the first coupling 60.

Moreover, the inner diameter di2 of the free cylindrical sleeve 72 is greater than the outer diameter de2 of the first coupling 60 so as to allow a range of movement of the first coupling 60 inside the free cylindrical sleeve 72 and consequently, inside the first frustoconical ring 64. Moreover, because of the mounting of the gooseneck pipe 54, the first coupling 60 can also move in axial translation relative to the first frustoconical ring 64. Clearly, in balance, the first coupling 60 extends inside the free cylindrical sleeve 72 so that their axes of symmetry are substantially parallel and the first centering lip 62 protrudes from the free cylindrical sleeve 72. On the other hand, when the first coupling 60 is made to move relative to the free cylindrical sleeve 72, that is to say relative to the first frustoconical ring 64 and to the top portion 50 of the post 28, a return force is generated, since the gooseneck pipe 54 deforms.

Moreover, the first centering lip 62 has a first female frustoconical bearing surface 94, while on the other side the second centering lip 88 has a second male frustoconical bearing surface 96 suitable for fitting into the first female frustoconical bearing surface 94. Additionally, the first coupling 50 has a first collar 98 surrounding the first centering lip 62 and forming a first substantially flared outer shoulder 100, while, on the other side, the second coupling 86 for its part has a second collar 102 having a second outer flared shoulder 104.

Therefore, when the coupling endpiece 32 is driven axially further toward the curved free end 58, simultaneously the second frustoconical ring 84 will cover the first frustoconical ring 64 and press on it, while the first and second centering lips 62, 88 come into contact with one another and, more precisely, the female frustoconical bearing surface 94 will also cover the male frustoconical bearing surface 96. In this way, before the frustoconical rings 64, 84 press against one another, the coupling endpiece nevertheless being guided in translation by means of the cylindrical sleeve 72, by virtue of the frustoconical bearing surfaces, female 94 and male 96, which come into contact with one another, the two couplings 60, 86 center relative to one another, the bearing surfaces rubbing one against the other while forming an inclined plane, one relative to the other, which can cause a clearance movement of the first coupling 60 inside the free cylindrical sleeve 72. On the other hand, when the frustoconical rings 64, 84 are pressing against one another, the coupling endpiece 32 is then prevented from moving toward the curved free end 58, while the second coupling 86 exerts a slight axial return force on the first coupling 60 which, for its part, is elastically returned by the gooseneck pipe 54, which makes it possible to ensure a pressure of the centering lips 62, 88 against one another and therefore a perfect hydraulic seal.

When this position is reached, the first operation consists in actuating the first concentric locking means 90, by bringing the two half-hoops closer together in order to engage respectively the two inner half-ribs 91, 93 in the groove 74. Therefore, the two frustoconical rings 64, 84 are totally secured to one another and mechanically lock the end 30 of the flexible pipe 22 and the curved free end 58 of the gooseneck pipe 54.

Figure 5:
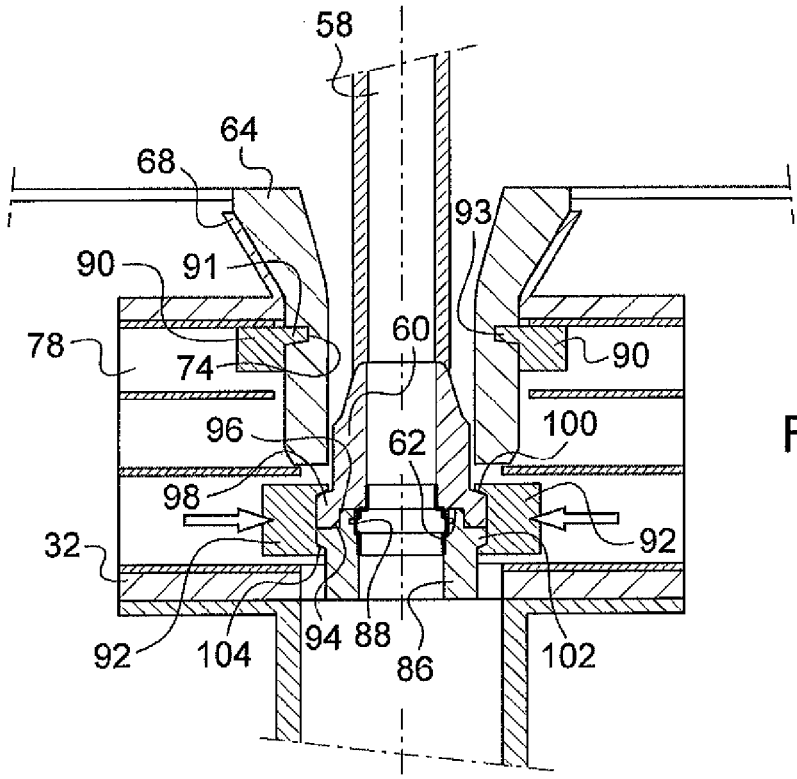
FIG. 5 is a schematic view in detail of the connection installation shown in FIG. 3 in a second position; and, FIGS. 6*a* to 6*d* are schematic views illustrating the main steps of application of the connection installation according to the invention.

Such a situation is found in FIG. 5 where the frustoconical rings 64, 84 are engaged in one another, while the two inner half-ribs 91, 93 are engaged in the groove 74. The centering lips 62, 88 have, the first 62, a facial circular slot, while on the other side, the second 88 has a facial circular rib engaged in the facial circular slot. In this way, the seal and the coaxiality are perfectly ensured. Moreover, the two hoop segments, forming the second locking means 92, are respectively brought closer to one another so that their two facing inner shoulders respectively press against the first outer shoulder 100 of the first collar 98 and the second outer shoulder 104 of the second collar 102. These outer shoulders 100, 104 being flared, the radial movement of the two hoop segments thereby causes the axial closing of the two couplings 60, 86. This makes it possible to perfect the seal. These second locking means 92 therefore form a hydraulic locking system ensuring a total seal of the join of the two couplings 60, 86.

The present invention also relates, according to a second aspect, to a method for placing and installing the hybrid tower. According to the invention, the flexible pipe 22 illustrated in FIG. 1 is connected to the rigid riser 12 previously installed and fixed in its vertical position. Therefore, the rigid riser 12 is fixed conventionally to the seabed 14 by means of an anchoring system 16 of the known type and it is therefore held in its vertical position by virtue of the flotation element, or the float 20, connected at the head of the pipe, and more precisely joined by means of the post 28 illustrated in FIG. 2, in order to tension the riser 12.

The post 28, or connection assembly, has been preinstalled between the float 20 and the top portion 18 of the rigid riser 12. The connection of the end 30 of the flexible pipe 22 is carried out according to the following steps illustrated in FIGS. 6*a* to 6*d*.

Therefore, FIG. 6*a* shows the float 20 from which the post 28, which holds the riser 12 via its top end 18, is suspended. It also shows the flexible pipe 22 which has been deployed vertically at a distance from the flotation element, or float 20, connected to the rigid riser 12. Moreover, the flexible pipe 22 is fitted with its coupling endpiece 32 and the two telescopic arms 34, 36 joined together by the crosspiece 46 are in this instance extended substantially perpendicularly to the axis of the flexible pipe 22 and they are held immobile in this position.

Then, the flexible pipe 22 is directed from the surface ship so as to allow the approach followed by the engagement of the articulated arm, and more precisely of the two telescopic arms 34, 36 joined together by their crosspiece 46, in the receptacle, or recess 52 situated on the connection element, or post 28. Also shown in FIG. 6*b* is the crosspiece 46 which joins together the two telescopic arms 34, resting pivotingly in the recess 52, while the two arms 34, 36 extend perpendicularly to the post 28 on either side of its top portion 50. In this position, the flexible pipe 22 and the riser 12 extend in substantially parallel directions.

In a third step, the articulation of the guide arm, and more precisely of the telescopic arms 34, 36 about their two first respective ends 38, 40, is then unlocked and the flexible pipe 22 is deployed in a predetermined curve, or else a predefined travel, so as to impose on the end 30 of the flexible pipe 22 a rotary movement, and more precisely a turning movement through approximately 180°.

Thus, FIG. 6*c* illustrates an intermediate phase of this turning movement. Specifically, the coupling endpiece 32 and the end 30 of the flexible pipe 22 are made to pivot in the direction of the arrow T illustrated in FIG. 6*c*. This pivoting or rotating movement of the end 30 of the flexible pipe 22 makes it possible to bring the latter into the axis of the frustoconical mouth, and more precisely of the first frustoconical ring 64 secured to the connection element or post 28. The perfect orientation of the flexible pipe 22 and more precisely of the coupling endpiece 32 in the axis of the first frustoconical ring 64, or of the mouth of the connection element, is obtained after the flexible pipe 22 has been sufficiently deployed below the level of the underwater connection installation 26 and when a point of contact is obtained between the abutment 89 and the end 30 of the flexible pipe 22.

Then, the end 30 of the flexible pipe 22 and more precisely the coupling endpiece 32 in line with it extends in the axis of the frustoconical mouth of the connection assembly comprising the first frustoconical ring 64 and the free cylindrical sleeve 72 in line with it and the coupling 60 protruding from the sleeve. FIG. 6*d* shows such an appropriate positioning at rest.

In this position, in which the end 30 of the flexible pipe and the coupling endpiece 32 extend substantially in the axis of the first frustoconical ring 64 and in which the telescopic arms 34, 36 extend parallel to this axis, the telescopic arms 34, 36 are then locked in rotation relative to the coupling endpiece 32 at the first end 38, 40. Following this, the end 30 of the flexible pipe and more precisely the coupling endpiece 32 is then engaged and connected to the frustoconical mouth of the connection assembly, namely to the first frustoconical ring 64, to the free cylindrical sleeve 72 that extends it and to the coupling 60, by a pulling movement. This pulling movement is carried out by the telescopic articulated arms 34, 36 of the guide element, or flange, which retract to drive the coupling endpiece 32 toward the top portion 50 of the post 28 until the end 30 of the flexible pipe fits flush with the connection assembly. The flush-fitting is then made much easier by the matching shapes of the mouth and of the end of the flexible pipe, or more precisely by the matching shapes on the one hand of the two frustoconical rings 64, 84 which are engaged in one another and which provide a first guidance, and on the other hand the lips 62, 88 of the couplings 60, 86 which also engage with one another, as has already been described with reference to FIGS. 4 and 5. Then, the first locking means 90, and the second locking means 92 are activated in sequence, first the mechanical locking together of the two frustoconical rings 64, 84, then the hydraulic locking of the two couplings 60, 86.

This double-locking system is extremely reliable. The weight of the flexible pipe 22 and the environment induce considerable forces at the connections of the flexible pipe, and more precisely of the second coupling 86, with the second coupling 60, or tubular joint. The mechanical forces are therefore absorbed by the mechanical locking system and the frustoconical part, more precisely the first frustoconical ring 64, and are transmitted to the metal structure of the post 28, or connection assembly, because of the difference in stiffness between the gooseneck pipe 54 and the metal part.

According to yet another subject, the invention also relates to the casing 78. The latter has the bottom 80 and on the other side the front face 82. The front face 82 has the second frustoconical ring 84. The casing 78 includes the first concentric locking means 90 consisting of two half-hoops having two inner half-ribs 91, 93. These concentric locking means 90 are installed inside the casing 78 and behind the second frustoconical ring 84. The casing 78 also includes the second locking means 92 installed close to the bottom 80 opposite to the first locking means 90. These second locking means 92 comprise two hoop segments having respectively two identical facing inner shoulders.

The invention claimed is:

1. An underwater connection installation for connecting a riser to a flexible pipe for carrying fluids, said installation comprising:

a post and a float for holding said post below a surface of the water, said post having a base suspending said riser and a top portion above said base:

a pipe comprising an inlet end secured to said base of said post and a free outlet end which extends into said top post portion;

a first coupling terminating said free outlet end, said first coupling comprising a first centering lip;

a coupling endpiece mounted at an end of said flexible pipe, said coupling endpiece comprising a second coupling including a second centering lip, said coupling endpiece and said post including respective mechanical guidance devices shaped for coaxially guiding said first and second couplings and supporting said first and second centering lips in contact with one another when said coupling endpiece and said free outlet end of said pipe are driven toward one another;

said mechanical guidance devices comprise matching frustoconical rings, one of said rings is mounted on said top post portion, around said free outlet end, so that respective axes of said one of said rings and said first coupling are substantially parallel, and the other of said rings is installed on said coupling endpiece coaxially with said second coupling;

such that driving of said coupling endpiece and of said outlet end toward each other causes engagement of said matching frustoconical rings in one another and causes coaxial alignment of said first and second couplings, while contact of said first and second lips causes self-centering of said couplings.

2. The connection installation as claimed in claim 1, further comprising a first locking device for locking said rings together when they are engaged in one another.

3. The connection installation as claimed in claim 2, further comprising a second locking device positioned and configured for locking said couplings together when said couplings are self-centered.

4. The connection installation as claimed in claim 3, wherein said coupling endpiece comprises a casing and said first locking device and said second locking device are installed in said casing.

5. The connection installation as claimed in claim 4, wherein said first coupling comprises a first collar, and said second coupling comprises a second collar;

said coupling endpiece comprises at least two hoop segments with two inner shoulders configured and operable to be driven radially toward one another to engage said collars and keep said collars engaged so as to form said second locking device.

6. The connection installation as claimed in claim 1, wherein said one of said frustoconical rings has a base secured to said top post portion and has another end with a top extended by a free cylindrical sleeve, and said first lip protruding from said free cylindrical sleeve.

7. The connection installation as claimed in claim 2, wherein said one of said frustoconical rings has a groove situated toward a cylindrical sleeve, and said coupling endpiece comprises a radial stopping device configured and positioned for engaging in said groove to form said first locking device.

8. The connection installation as claimed in claim 1, wherein said first coupling is configured and mounted so as to have a range of movement inside a cylindrical sleeve.

9. The connection installation as claimed in claim 1, wherein said other of said frustoconical rings has a top secured to said coupling endpiece and has another end with a free base protruding from said coupling endpiece.

10. The connection installation as claimed in claim 1, wherein said first centering lip has a first female frustoconical bearing surface, and said second centering lip has a second male frustoconical bearing surface.

11. The connection installation as claimed in claim 1, wherein said inlet end of said pipe is secured to said base, and said pipe extends freely in said post, so that said free end of said pipe moves elastically relative to said top post portion.

12. The connection installation as claimed in claim 1, further comprising a retractable flange on said coupling endpiece configured for coming to face said second coupling, while said post has a recess in its said top portion opposite to said first coupling of said pipe free end, and said retractable flange is configured for being brought into engagement in said recess, while said coupling endpiece is configured to come to face said free outlet end, said retractable flange being retractable to drive said coupling endpiece and said free outlet end toward one another.

13. The connection installation as claimed in claim 12, wherein said retractable flange comprises two telescopic arms each having a first end mounted coaxially and in a diametrically opposite position on said coupling endpiece and having two second opposite ends joined together by a crosspiece.

14. The connection installation as claimed in claim 12, wherein said retractable flange is mounted pivotingly on said coupling endpiece.

15. The connection installation as claimed in claim 14, wherein said coupling endpiece comprises a stop device for stopping pivoting of said retractable flange at a position that is substantially perpendicular to an axis of said second coupling and in said position facing said second coupling.

16. The connection installation as claimed in claim 12 further comprising said post has a receiving device forming an abutment between said top portion of said pipe and said base of said pipe to receive said coupling endpiece as a support.

17. A method of laying a connection installation as claimed in claim 11, said method comprising the following steps:

supplying a flexible pipe fitted with a coupling endpiece at one end of said pipe, said coupling endpiece having a retractable flange;

supplying a post having a base and a top portion above said base, said post comprising a pipe having an inlet end secured to said base and a free outlet end which extends into said top post portion, said top portion having a device for connecting to said retractable flange;

supplying a float and suspending said post below a sea surface, between the sea surface and a seabed;

suspending a riser from said base of said post and anchoring said riser in said seabed;

paying out said flexible pipe from said surface by engaging said retractable flange to be swivelable at said of said top post portion so that said coupling endpiece swivels around said top post portion in order to extend facing said curved free end; and retracting said retractable flange in order to link together said curved free end and said coupling endpiece.

18. The connection installation as claimed in claim 1, wherein said pipe is a gooseneck shaped pipe and said free outlet end thereof is curved so that said outlet end extends generally down in said post portion.

19. The connection installation as claimed in claim 1, further comprising a locking device positioned and configured for locking said couplings together when said couplings are self-centered.

* * * * *

UNITED STATES PATENT AND TRADEMARK OFFICE

CERTIFICATE OF CORRECTION

PATENT NO. : 8,418,766 B2
APPLICATION NO. : 12/863228
DATED : April 16, 2013
INVENTOR(S) : Ange Luppi It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 288 days.

Signed and Sealed this
First Day of September, 2015

Michelle K. Lee

Michelle K. Lee
*Director of the United States Patent and Trademark Office*